US007255236B1

(12) United States Patent
Sauder et al.

(10) Patent No.: US 7,255,236 B1
(45) Date of Patent: Aug. 14, 2007

(54) SHELF ASSEMBLY

(75) Inventors: Myrl D. Sauder, Archbold, OH (US); Ronald D. Roth, Wauseon, OH (US)

(73) Assignee: Sauder Woodworking Co., Archbold, OH (US)

( * ) Notice: Subject to any disclaimer, the term of this patent is extended or adjusted under 35 U.S.C. 154(b) by 150 days.

(21) Appl. No.: 11/046,718

(22) Filed: Jan. 31, 2005

(51) Int. Cl.
*A47F 5/08* (2006.01)

(52) U.S. Cl. ..... 211/90.01; 211/135; 211/183

(58) Field of Classification Search ..... 211/90.01, 211/94.01, 183, 87.01, 134, 153, 135; 108/27, 108/152, 108; 52/36.4, 36.5
See application file for complete search history.

(56) References Cited

U.S. PATENT DOCUMENTS 2,646,326 A * 7/1953 Stanitz ..... 108/27
3,102,499 A * 9/1963 Shelor ..... 108/28
3,437,214 A * 4/1969 Sainsbury ..... 211/90.04
4,373,448 A * 2/1983 Pallotta ..... 108/29
4,691,887 A 9/1987 Bessinger
5,018,628 A * 5/1991 Schenck et al. ..... 211/153
5,044,285 A * 9/1991 Wolfe, III ..... 108/152
5,253,932 A * 10/1993 Nesovic ..... 312/140.3
5,406,894 A * 4/1995 Herrmann et al. ..... 108/108
5,415,302 A * 5/1995 Carlson et al. ..... 211/187
5,477,594 A * 12/1995 LePage ..... 27/1
5,499,886 A 3/1996 Short et al.
5,606,238 A * 2/1997 Spellman et al. ..... 320/110
5,677,030 A * 10/1997 Shanok et al. ..... 428/122
6,105,233 A * 8/2000 Neal ..... 29/451
6,343,454 B1 * 2/2002 Fisher ..... 52/782.2
6,811,045 B1 * 11/2004 Masker et al. ..... 211/153
7,093,726 B1 * 8/2006 Holztrager ..... 211/90.01

* cited by examiner

*Primary Examiner*—Jennifer E. Novosad
(74) *Attorney, Agent, or Firm*—MacMillan, Sobanski & Todd, LLC

(57) ABSTRACT

A shelf assembly having at least one bracket including a top member, a bottom member and a side member. The top member is positioned in opposed spaced relationship with the bottom member. The assembly includes a shelf having at least one mounting edge and at least one trim edge. The mounting edge is adapted for positioning in the space defined by the top and bottom members for support by the bracket. The trim edge has an outwardly projecting tongue having a terminal portion with a terminal geometric configuration. The assembly further includes at least one trim member having a groove with a groove geometric configuration corresponding to the terminal geometric configuration to allow the groove to receive the tongue to join together the shelf and the trim member.

2 Claims, 14 Drawing Sheets

SHELF ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The present invention relates generally to shelving. More specifically, the invention is directed to a ready-to-assemble shelf assembly.

BACKGROUND OF THE INVENTION

It has been found that there is a need for a ready-to-assemble shelf assembly that can be easily and quickly constructed and positioned on walls. The present invention satisfies this need.

BRIEF SUMMARY OF THE INVENTION

The shelf assembly of the present invention has at least one bracket including a top member, a bottom member and a side member. The top member is positioned in opposed spaced relationship with the bottom member.

The assembly includes a shelf having at least one mounting edge and at least one trim edge. The mounting edge is adapted for positioning in the space defined by the top and bottom members for support by the bracket. The trim edge has an outwardly projecting tongue having a terminal portion with a terminal geometric configuration.

The assembly further includes at least one trim member having a groove with a groove geometric configuration corresponding to the terminal geometric configuration to allow the groove to receive the tongue to join together the shelf and the trim member.

The primary object of the present invention is to provide a shelf assembly that can be easily and quickly constructed and positioned on walls.

Other objects and advantages of the invention will become apparent to those skilled in the art upon a review of the following detailed description of the invention and the accompanying drawings.

DETAILED DESCRIPTION OF THE INVENTION

Figure 1:
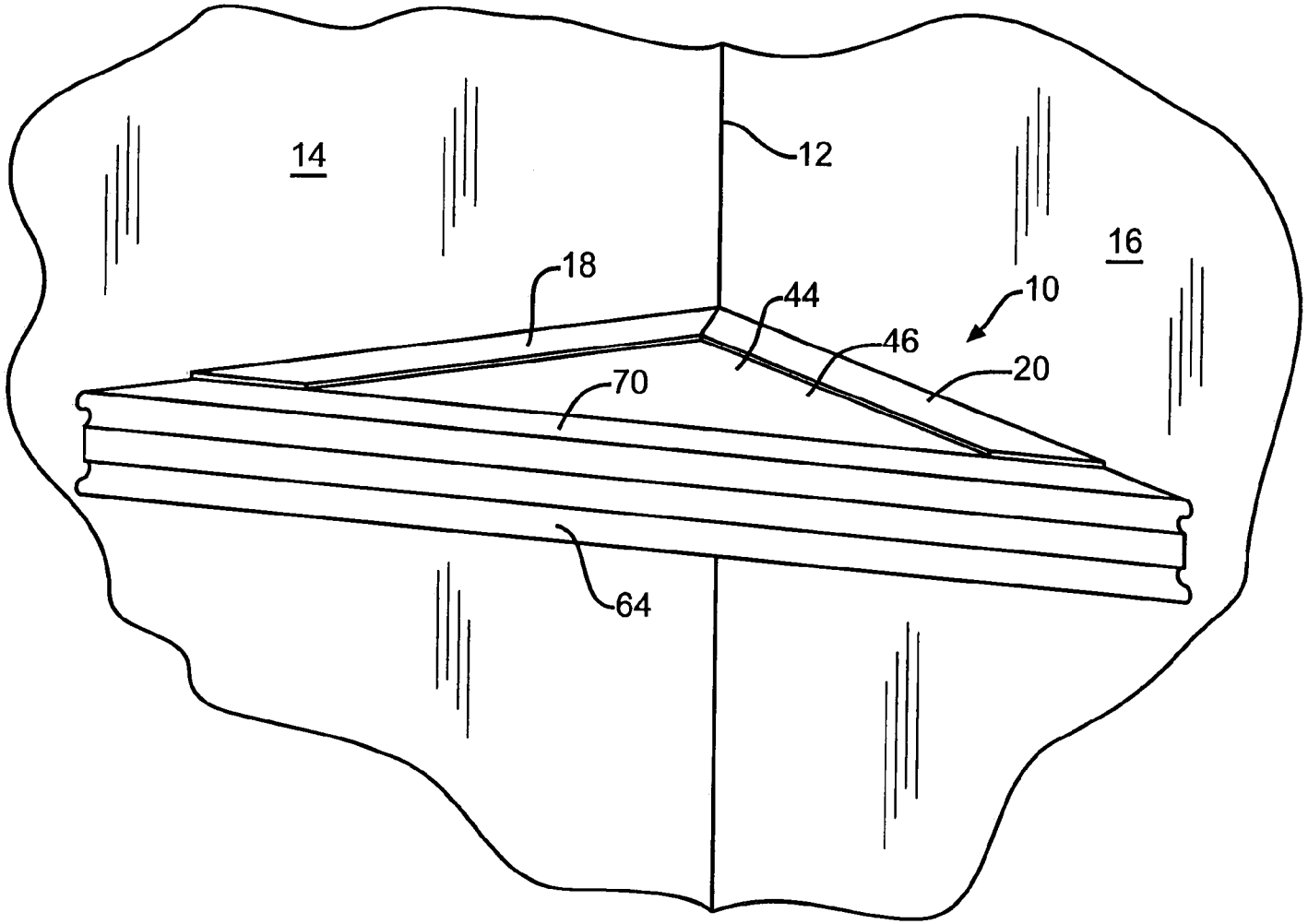
FIG. 1 is a front perspective view of a shelf assembly according to the present invention positioned in a corner formed by walls.

The preferred embodiments and best mode of the present invention will now be described in detail with reference being made to the drawings, which constitute a portion of the disclosure. In the drawings, the shelf assembly of the invention is indicated generally by the reference number "10".

Figure 2:
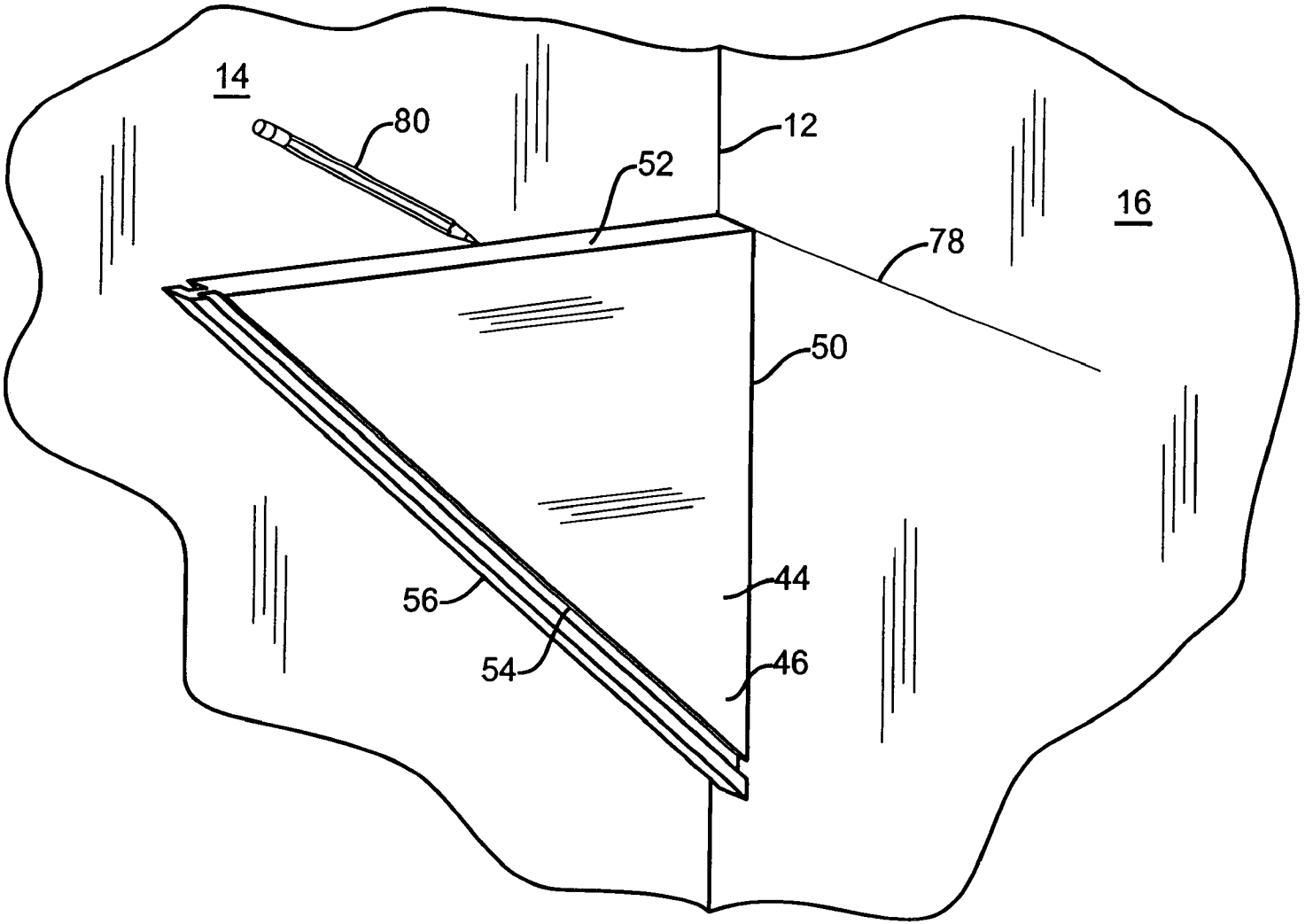
FIG. 2 is a front perspective view showing a shelf according to the present invention being used to mark the walls.
Figure 3:
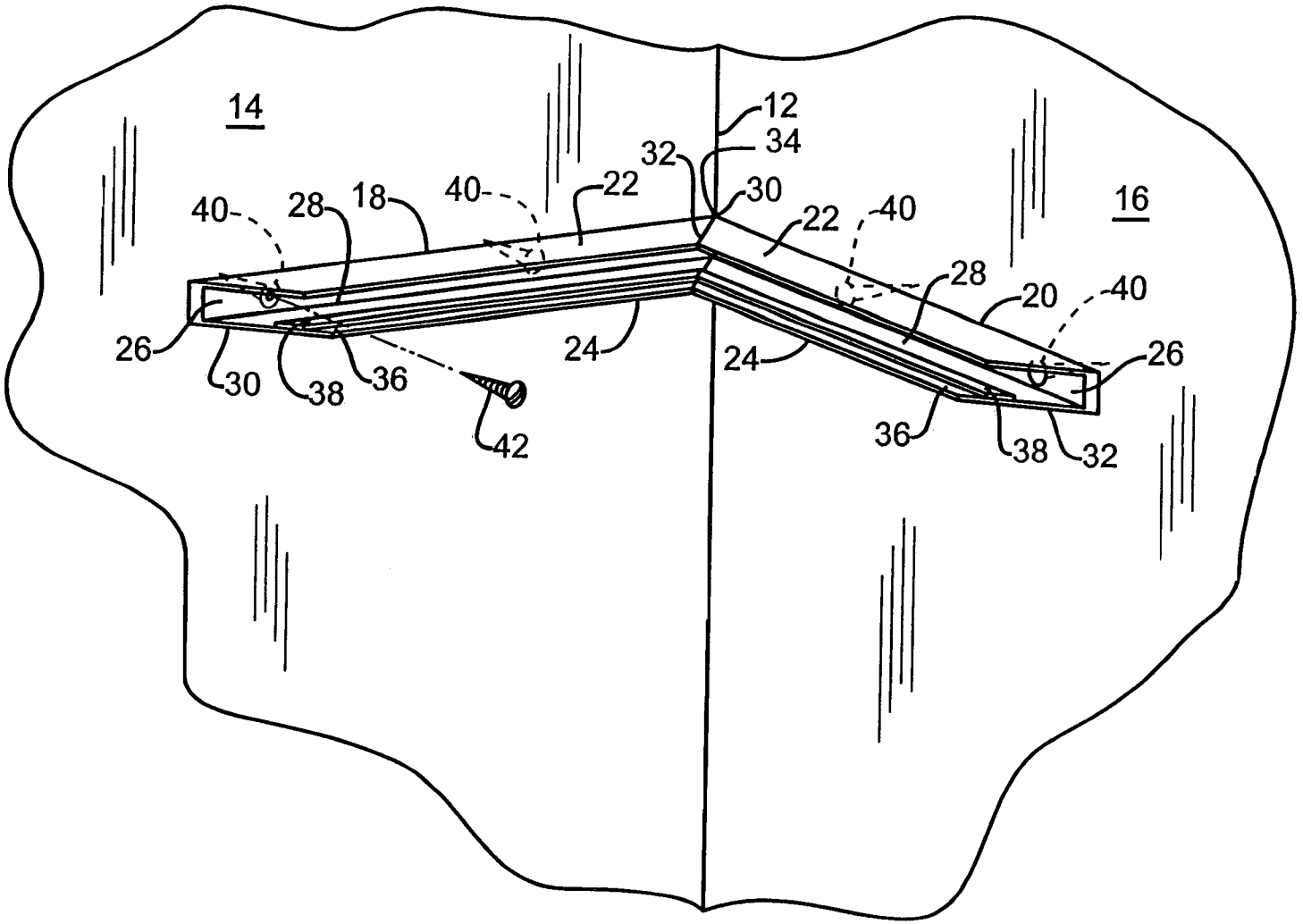
FIG. 3 is a front perspective view showing brackets according to the present invention being positioned on the walls.

Referring to FIGS. 1-8, a shelf assembly 10 for use in a corner 12 formed by walls 14 and 16 is shown. Referring to FIG. 3, the shelf assembly 10 has a U-shaped first bracket 18 and a U-shaped second bracket 20. Each of the first and second brackets 18 and 20 includes a top member 22, a bottom member 24 and a side member 26. The top member 22 is positioned in opposed spaced parallel relationship with the bottom member 24 to define a space 28. The side member 26 extends in a perpendicular relationship between the top and bottom members 22 and 24. Each of the first and second brackets 18 and 20 includes a first end 30 and a second end 32. As shown in FIG. 3, the first and second ends 30 and 32 are formed to allow, for example, the second end 32 of the first bracket 18 to be brought together with the first end 30 of the second bracket 20 at a right angle to form a miter joint for positioning at the corner 12. In a preferred embodiment, the second end 32 and the first end 30 are connected by a flexible hinge 34. Still referring to FIG. 3, each bottom member 24 has an interior surface 36 that includes friction material such as raised longitudinally extending gripper strips 38. Each side member 26 defines openings 40 that receive fasteners 42 for attaching the first and second brackets 18 and 20 to the walls 14 and 16, respectively.

The first and second brackets 18 and 20 are preferably constructed of plastic having decorative laminate exterior surfaces. The hinge 34 and the gripper strip 38 are constructed of plastic. These materials provide strength, durability, flexibility and pleasing appearances.

Figure 4:
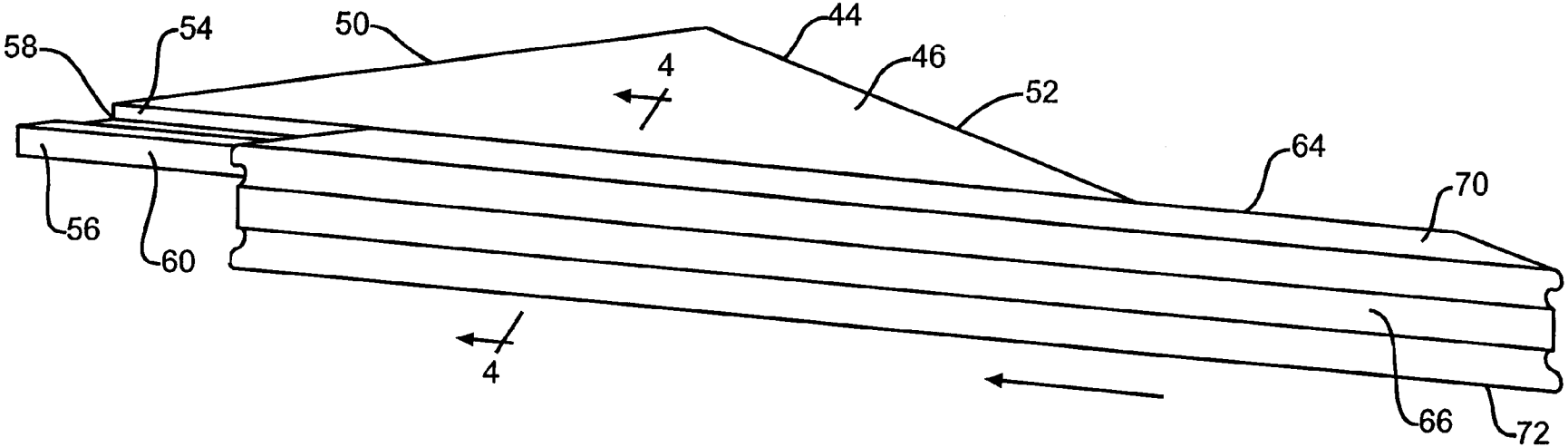
FIG. 4 is a front perspective view showing a trim member according to the present invention being positioned on the shelf.
Figure 5:
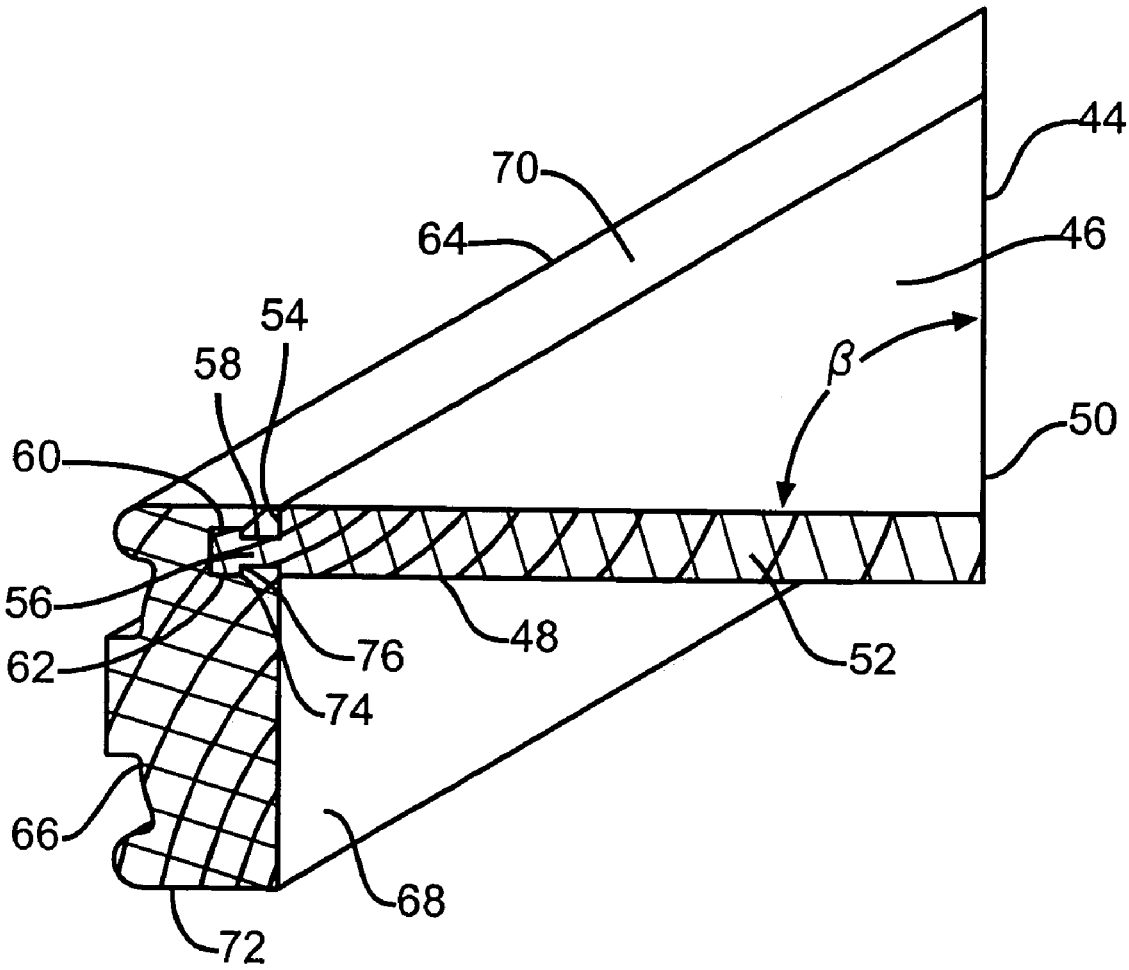
FIG. 5 is a side perspective view showing the top of the trim member flush with the upper surface of the shelf.

Referring to FIGS. 4 and 5, the shelf assembly 10 has a triangular-shaped shelf 44 including a planar first surface 46, a planar second surface 48, a first mounting edge 50 and a second mounting edge 52. The first and second mounting edges 50 and 52 are sized and adapted for positioning in the spaces 28 defined by the first and second brackets 18 and 20, respectively. As shown in FIG. 5, the first and second mounting edges 50 and 52 meet at a right angle β. Still referring to FIGS. 4 and 5, the shelf 44 also includes a trim edge 54 that has an outwardly projecting tongue 56 having a central portion 58 and a terminal portion 60 with a terminal geometric configuration 62. In a preferred embodiment, the geometric configuration 62 is a rectangle. However, in other embodiments, the geometric configuration 62 can be a square or a circle. Referring to FIGS. 4 and 5, the tongue 56 extends longitudinally along the trim edge 54. As shown in FIG. 5, the tongue 56 is positioned off-center on the trim edge 54 adjacent to the second surface 48.

Still referring to FIGS. 4 and 5, the shelf assembly 10 has a trim member 64 including a front surface 66, a back surface 68, a top 70 and a bottom 72. As shown in FIG. 5, the back surface 68 has a groove 74 with a groove geometric configuration 76 that corresponds to the terminal geometric configuration 62. This allows the groove 74 to receive the tongue 56 to join together the shelf 44 and the trim member 64.

The shelf 44 and the trim member 64 are preferably constructed of composite materials having decorative laminate exterior surfaces. These materials provide strength, durability and pleasing appearances.

Figure 6:
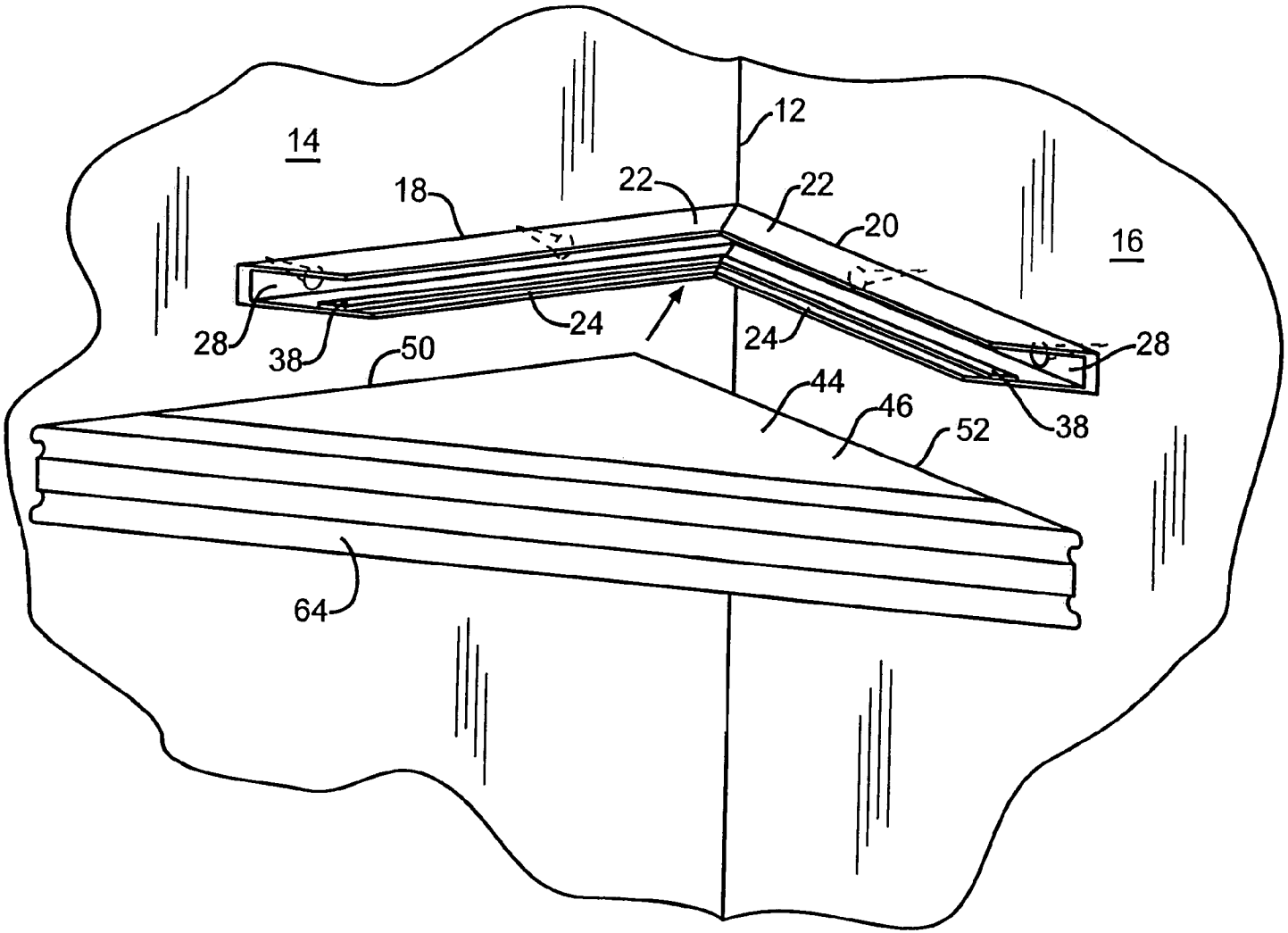
FIG. 6 is a front perspective view showing the shelf with the trim member being positioned in the brackets.
Figure 7:
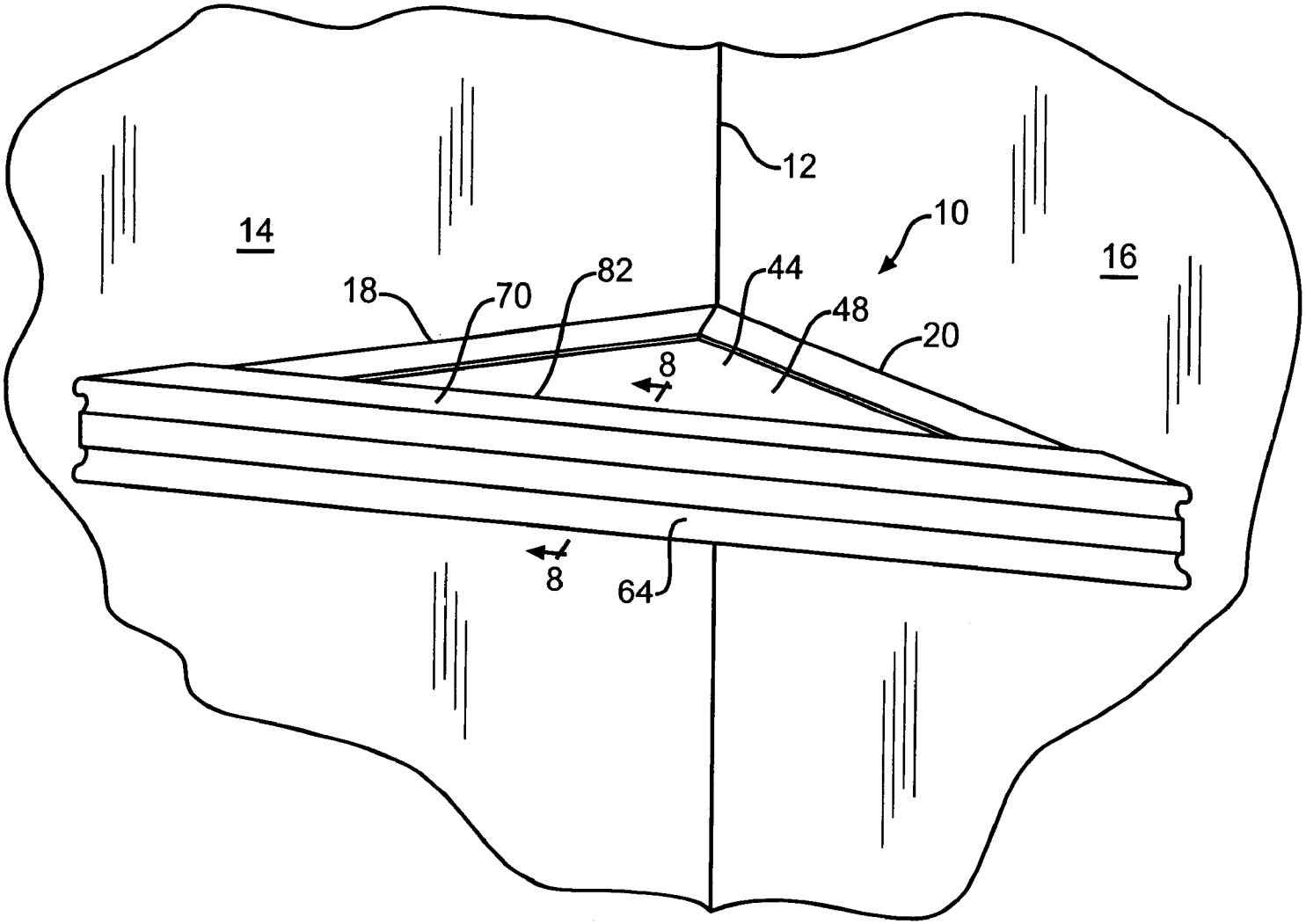
FIG. 7 is a is a front perspective view similar to FIG. 1 in which the top of the trim member is above the upper surface of the shelf to form a rim.
Figure 8:
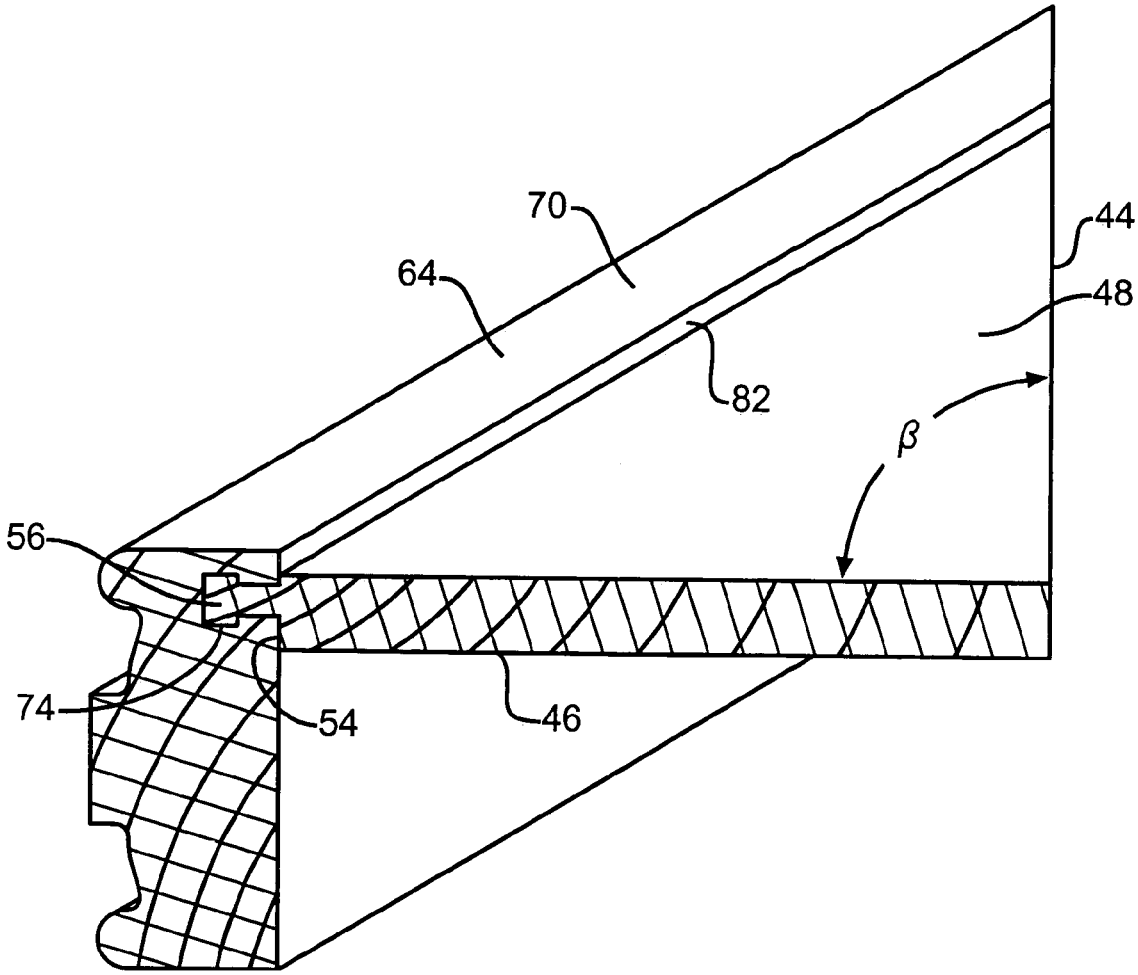
FIG. 8 is a cross-sectional view taken along line 8-8 of FIG. 7.

Referring to FIGS. 1-8, the components of the shelf assembly 10 as shown in FIG. 1 are provided to the user in a ready-to-assemble state. As shown in FIG. 2, the first and second mounting edges 50 and 52 can be used as straight edges to make marks 78 by a marking device 80 on the walls 14 and 16 at the corner 12. As shown in FIG. 3, the first and second brackets 18 and 20 are attached to the walls 14 and 16 by inserting the fasteners 42 through the openings 40 into the walls 14 and 16. Referring to FIGS. 4 and 5, the trim member 64 is positioned on the trim edge 54 of the shelf 44 by sliding the tongue 56 into the groove 74. As shown in FIG. 5, when the first surface 46 of the shelf 44 is facing upwardly, the top 70 of the trim member 64 is flush with the first surface 46. Referring to FIG. 6, the shelf assembly 10 of FIG. 1 is completed by positioning the first and second mounting edges 50 and 52 in the spaces 28 defined by the first and second brackets 18 and 20 so that the first and second surfaces 46 and 48 engage the top and bottom members 22 and 24, respectively, for a friction fit. The gripper strips 38 on the bottom members 24 engage the second surface 48 to maintain the shelf 44 in the first and second brackets 18 and 20. Referring to FIGS. 7 and 8, the shelf assembly 10 can be alternatively constructed so that the second surface 48 of the shelf 44 is facing upwardly. Due to the off-centered positioning of the tongue 56 as described above, the top 70 of the trim member 64 is positioned above the second surface 48 to form a rim 82. The rim 82 prevents objects from falling from the shelf 44.

As it will be appreciated, the shelf assembly 10 of the present invention provides a ready-to-assemble shelf assembly that can be easily and quickly constructed and positioned on walls. The shelf assembly 10 provides a scribed corner fit that tolerates out-of-square corners and other imperfections that can occur in drywall construction.

Figure 11:
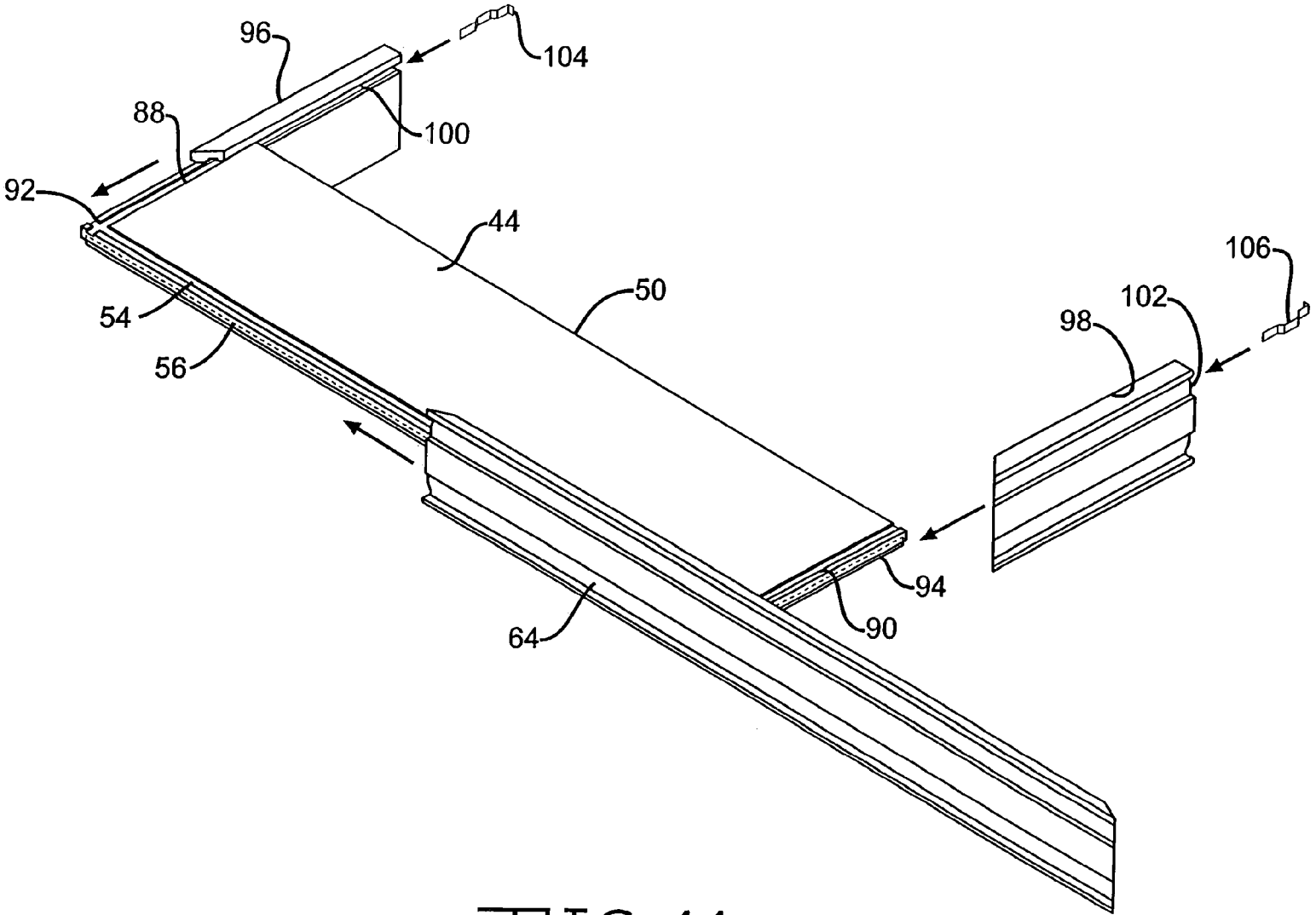
FIG. 11 is a front perspective view showing the trim members being positioned on the shelf.

Referring to FIGS. 9-14, an alternative embodiment shelf assembly 10 for use on a straight wall 84 supported by studs 86 is shown. This embodiment includes the elements as described above with the exception of the second bracket 20 and the second mounting edge 52 of the shelf 44. Instead, the shelf assembly 10 includes a single bracket 18 and a single mounting edge 50. In addition, this embodiment has first and second side trim edges 88 and 90 with tongues 92 and 94 and first and second side trim members 96 and 98 having grooves 100 and 102, which include the elements as described above for the trim edge 54, the tongue 56, the trim member 64 and the groove 74, respectively. As shown in FIG. 11, this embodiment includes first and second spring retention clips 104 and 106 for insertion in the grooves 100 and 102, respectively, to secure the first and second trim members 96 and 98, respectively.

Figure 9:
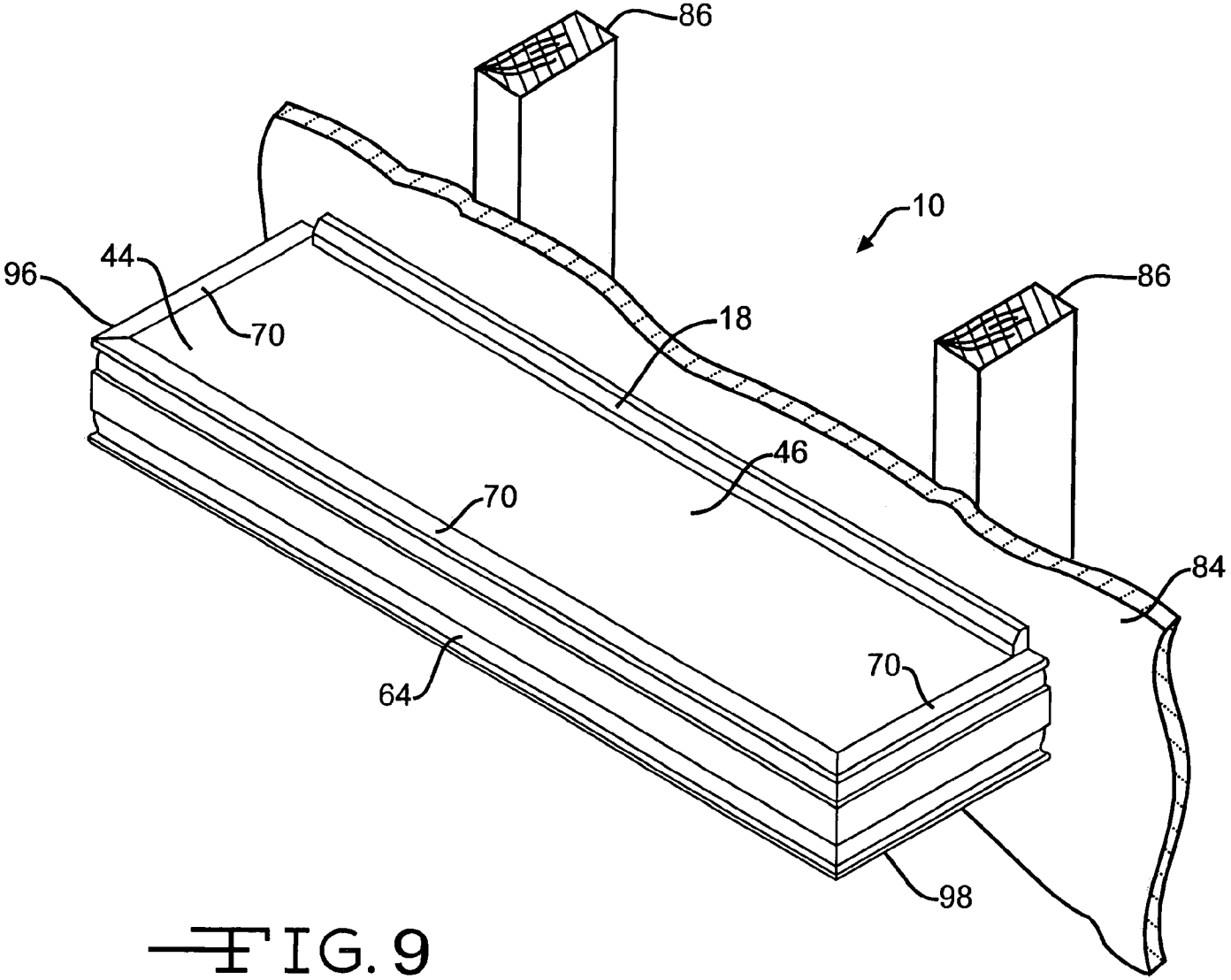
FIG. 9 is a front perspective view showing an alternative embodiment shelf assembly according to the present invention positioned on a straight wall in which the tops of the trim members according to the present invention are flush with the upper surface of a shelf according to the present invention.
Figure 10:
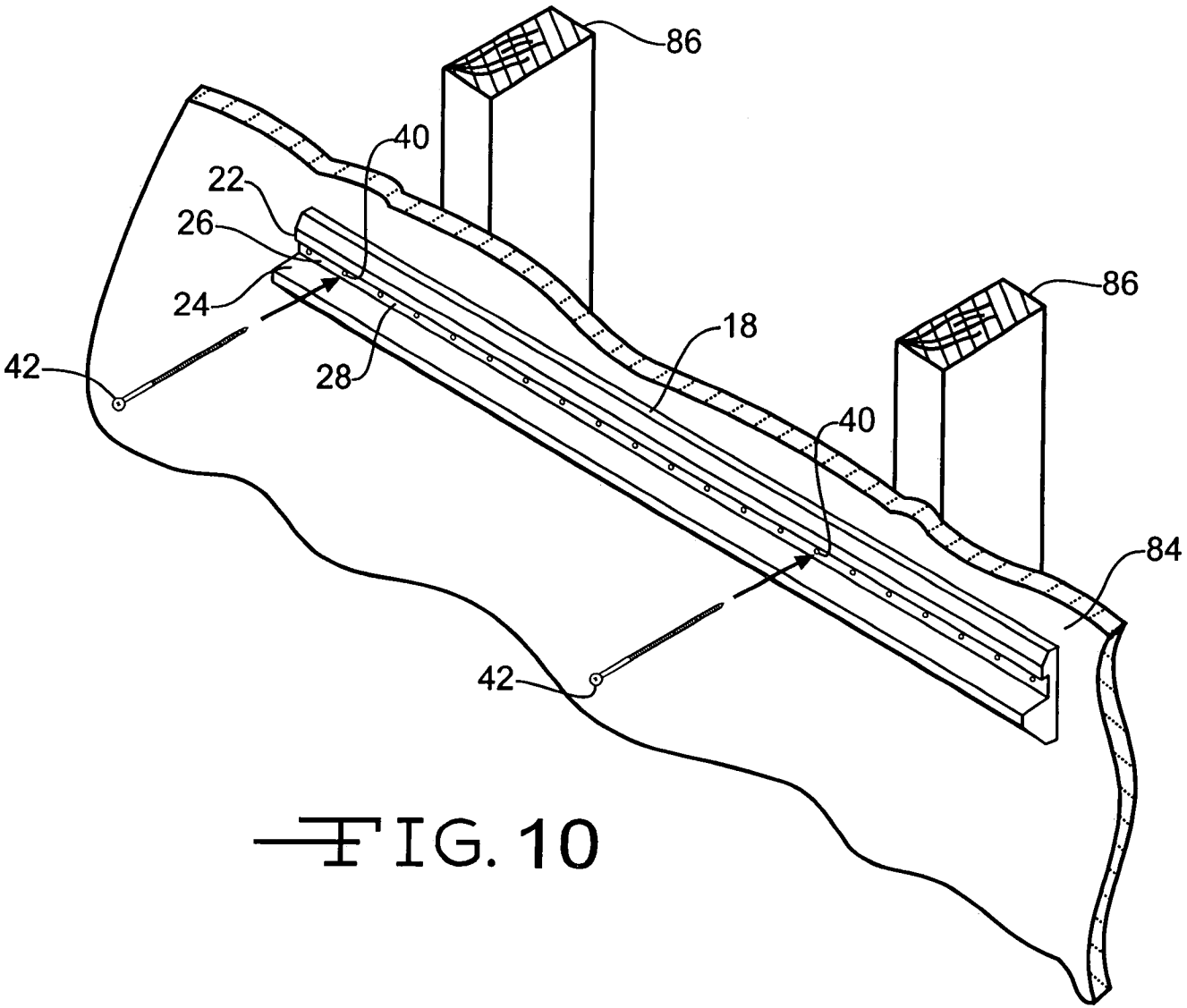
FIG. 10 is a front perspective view showing a bracket according to the present invention being positioned on the wall.
Figure 12:
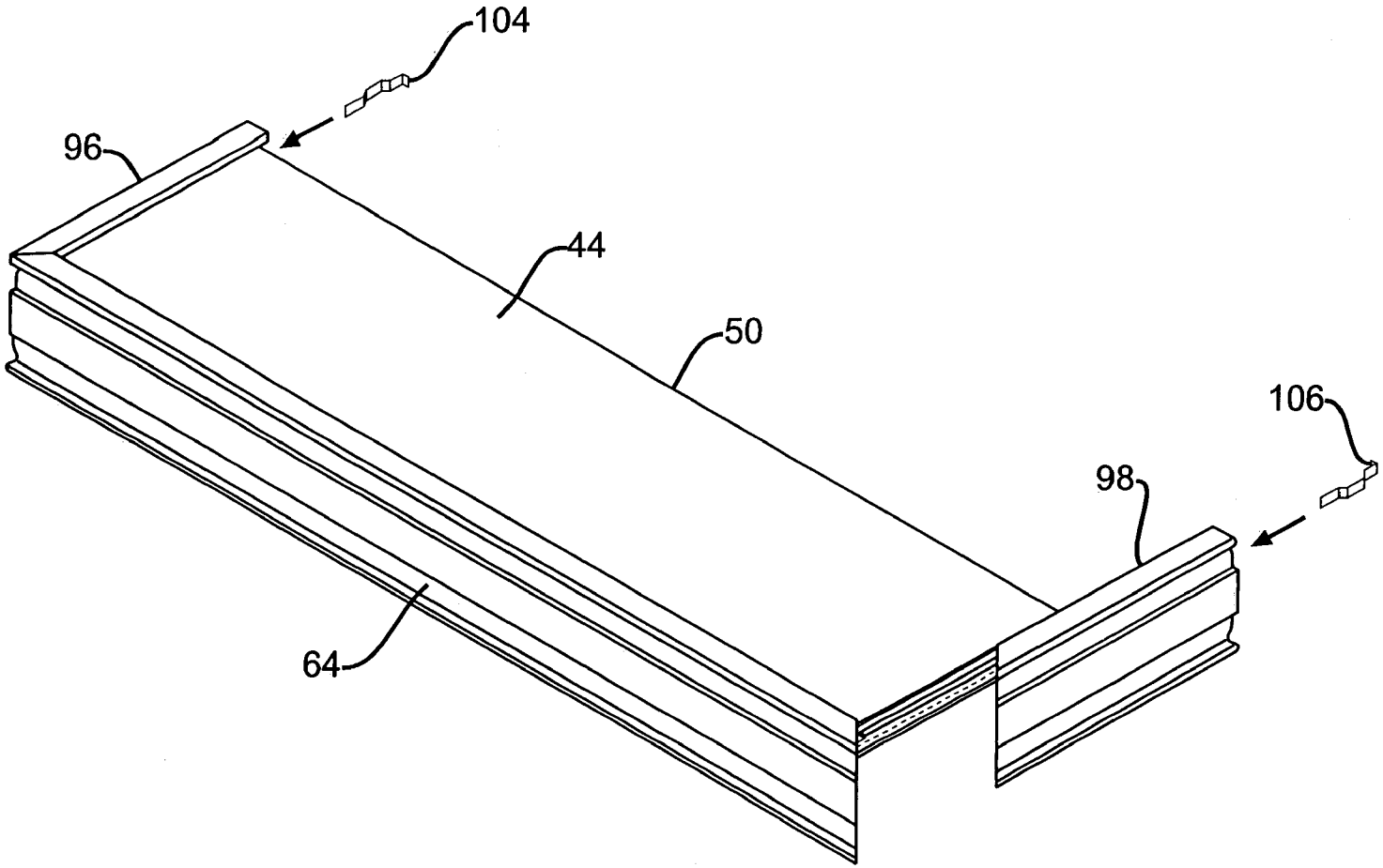
FIG. 12 is a view similar to FIG. 11.
Figure 13:
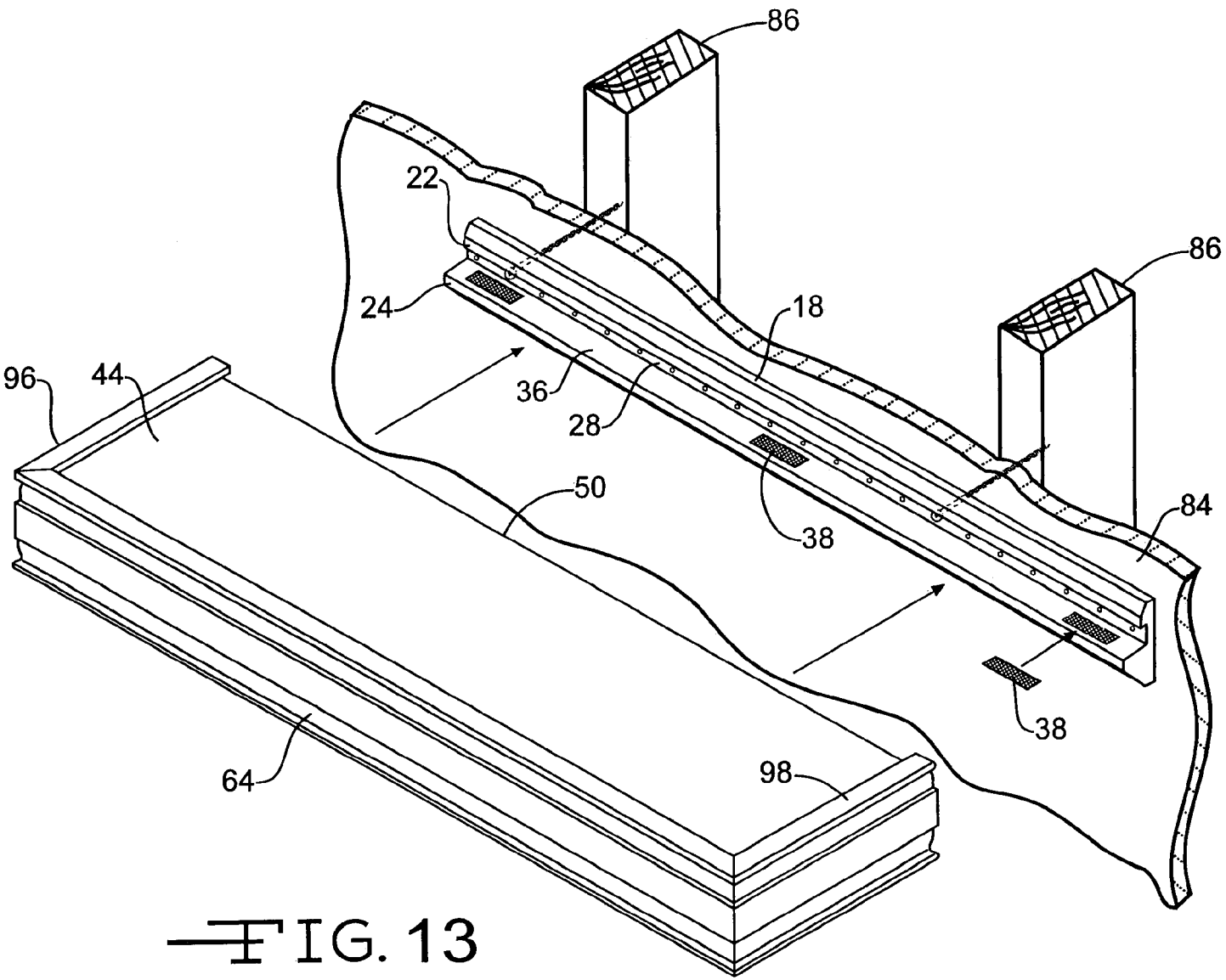
FIG. 13 is a front perspective view showing the shelf with the trim members being positioned in the bracket.
Figure 14:
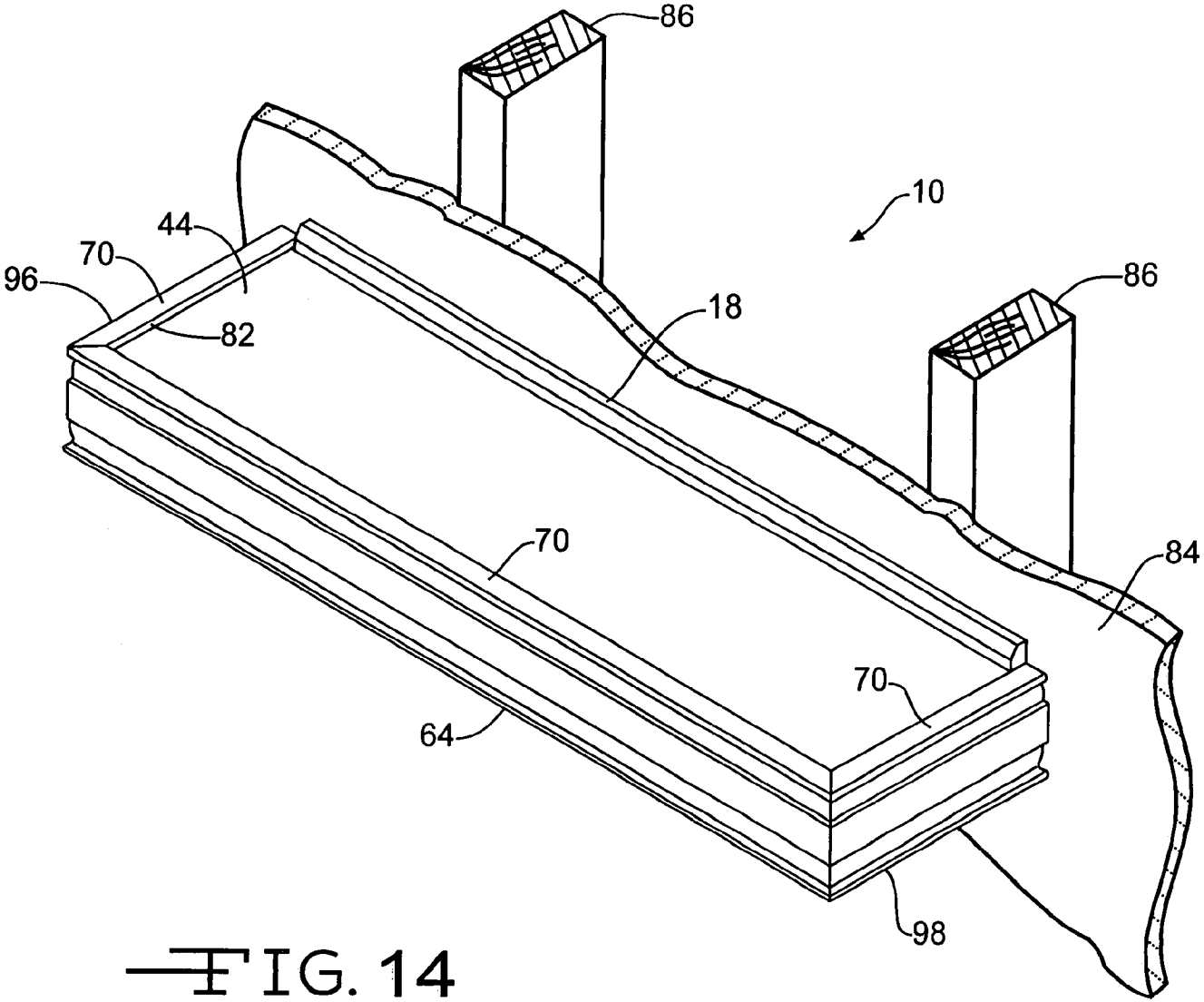
FIG. 14 is a front perspective view similar to FIG. 9 in which the tops of the trim members are above the upper surface of the shelf to form a rim.

Referring to FIGS. 10-14, the shelf assembly 10 is constructed by attaching the bracket 18 to the wall 84 by inserting the fasteners 42 through the openings 40 into the wall 84 and the studs 86. As shown in FIGS. 11 and 12, the trim member 64 and the first and second side trim members 96 and 98 are positioned on the trim edge 54 and the first and second side trim edges 88 and 90 as described above. The clips 104 and 106 are inserted in the grooves 100 and 102. Referring to FIG. 13, the shelf 44 is then positioned in the bracket 18 as described above. As shown in FIGS. 9 and 14, the upper surface of the shelf 44 can either be flush with the tops 70 of the trim members 64, 96 and 98 (FIG. 9) or spaced to form a rim 82 (FIG. 14).

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A shelf assembly comprising:

a bracket having a top member, a bottom member and a side member, the top member being positioned in opposed spaced relationship with the bottom member;

a shelf having a mounting edge, a front trim edge and first and second side trim edges, the mounting edge being adapted for positioning in the space defined by the top and bottom members for support by the bracket, the front, first and second trim edges having outwardly projecting tongues having terminal portions with terminal geometric configurations; and a front trim member and first and second side trim members having grooves with groove geometric configurations corresponding to the terminal geometric configurations of the front, first and second trim edges, respectively, to allow the grooves to receive the tongues to join together the shelf and the trim members.

2. The shelf assembly of claim 1, wherein the assembly has a first spring retention clip being adapted to secure the first trim member on the first trim edge and a second spring retention clip being adapted to secure the second trim member on the second trim edge.

* * * * *